US006383572B1

(12) United States Patent
De Graaf et al.

(10) Patent No.: US 6,383,572 B1
(45) Date of Patent: May 7, 2002

(54) APPARATUS FOR APPLYING MULTI-COMPONENT COATING COMPOSITIONS

(75) Inventors: Daniel De Graaf, Hilversum; Johannes Anthonius Jansen, Oegstgeest; Herman Ligtvoet, Leiden; Josef Pancratius Maria Jonker, Sassenheim, all of (NL)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/398,537

(22) Filed: Sep. 17, 1999

Related U.S. Application Data

(63) Continuation of application No. PCT/EP98/01581, filed on Mar. 13, 1998.

(30) Foreign Application Priority Data

Mar. 19, 1997 (EP) ..... 97200807

(51) Int. Cl.[7] ..... B05B 7/04; B05D 1/02

(52) U.S. Cl. ..... 427/421; 427/426; 118/300; 118/688

(58) Field of Search ..... 427/421, 426; 118/300, 302, 688, 693, 694; 222/32, 58, 61, 63, 64, 282, 334; 239/303, 427

(56) References Cited

U.S. PATENT DOCUMENTS

| | | | | | |
|---|---|---|---|---|---|
| 4,019,653 | A | | 4/1977 | Scherer et al. | 222/1 |
| 4,062,220 | A | * | 12/1977 | Taube et al. | 73/3 |
| 4,193,546 | A | * | 3/1980 | Hetherington et al. | 239/112 |
| 4,848,657 | A | * | 7/1989 | Hashimoto et al. | 239/11 |
| 4,928,880 | A | | 5/1990 | Prus et al. | 239/8 |
| 4,998,672 | A | * | 3/1991 | Bordaz et al. | 239/585 |
| 5,092,492 | A | * | 3/1992 | Centea | 222/137 |
| 5,316,217 | A | * | 5/1994 | Guzowski et al. | 239/71 |
| 5,388,761 | A | * | 2/1995 | Langeman | 239/1 |
| 5,425,968 | A | * | 6/1995 | Larson | 427/372.2 |
| 5,755,884 | A | * | 5/1998 | Buckler et al. | 118/317 |
| 5,992,686 | A | * | 11/1999 | Cline et al. | 222/1 |
| 6,010,032 | A | * | 1/2000 | Vermylen et al. | 222/1 |

FOREIGN PATENT DOCUMENTS

| | | | |
|---|---|---|---|
| DE | 44 13 249 | 10/1995 | B05D/1/34 |
| EP | 0 292 354 | 11/1988 | B05B/12/08 |
| FR | 2 426 561 | 12/1979 | B29F/3/06 |
| FR | 2 618 354 | 1/1989 | B05B/7/12 |
| GB | 1 313 182 | 4/1973 | C08G/35/00 |
| GB | 2 301 786 | 12/1996 | B05B/7/04 |
| JP | 91-127655 | 5/1991 | B05B/7/02 |
| WO | 89/08390 | 9/1989 | A01M/7/00 |

* cited by examiner

*Primary Examiner*—Fred J. Parker
(74) *Attorney, Agent, or Firm*—Joan M. McGillycuddy

(57) ABSTRACT

The invention relates to an apparatus for applying multi-component coating compositions comprising at least two dosing devices, an air-assisted spray gun, and a controlling device, each dosing device comprising a supply container comprising one component of the multi-component coating composition, a motoring device, and a metering device, the supply container being connected to the metering device, the metering device being connected to the motoring device and to the air-assisted spray gun, the connecting line between at least one metering device and the air-assisted spray gun being fitted with a pressure transducer for measuring a decrease in pressure in the connecting line, the pressure transducer being connected to the controlling device, and the controlling device being connected to the motoring devices, the controlling device capable of comparing the decrease in pressure in the connecting line with a set value, for starting up the motoring devices, and controlling the power of the motoring devices to keep the pressure in the connecting line to the set value.

15 Claims, 9 Drawing Sheets

APPARATUS FOR APPLYING MULTI-COMPONENT COATING COMPOSITIONS

This is a continuation of International application number PCT/EP98/01581 which was filed on Mar. 13,1998.

FIELD OF INVENTION

This invention relates to an apparatus for applying multi-component coating compositions and to a process for applying such a coating composition to finish a substrate.

BACKGROUND OF INVENTION

In finish applications, the coating material applied to a substrate as a finish typically is the product of a multi-component coating composition. Generally, in a two-component coating composition, the first component essentially comprises the binder. The second component comprises the hardener required to react with the binder in the first component. The proper mixing ratio of the components is determined by the proper stoechiometric ratios of the reactive parts of the components needed for the reaction to take place. Either component may also contain catalysts for promoting and initiating the reaction, as well as additives, reducers, and pot life extenders. In some cases, more than two components may be involved. For example, a catalyst may be present in a third component.

Presently there is a wide range of apparatus for mixing multi-component coating compositions and delivering them to atomizers or dispensing equipment in proper ratios. For example, such systems are disclosed in U.S. Pat. No. 5,425,968, DE-A-29 14 684, EP-A-0 311 792, EP-A-0 478 944, and GB 1 313 182. However, the dosing cylinders used in these apparatus provide a fixed mixing ratio. If this mixing ratio has to be changed, the apparatus has to be dismantled. If the dosing cylinders are mounted on a rod assembly, they have to be loosened manually and moved along the rod assembly. In other cases, the dosing cylinders have to be changed. It is also possible to mechanically adjust the dosing volume of the cylinders. However, mechanically changing mixing ratios is time-consuming and cannot be repeated exactly.

Also apparatus are known where the mixing ratio is monitored and/or changed electronically. U.S. Pat. No. 4,019,653 discloses such an apparatus where a control unit receives a preset signal representative of the desired flow ratio, monitors the flow rate signals from the respective lines, calculates the actual ratio, compares it with the desired ratio, and adjusts a controllable valve in one connecting line to affect the flow rate and thereby achieve the desired ratio. The disadvantage of this apparatus is that the start-up is not instantaneous. More particularly, for a predetermined time after the spray gun trigger is actuated, the flow rate information is disconnected from the control valve because the initial transient flow signals may be erratic, slow, and unreliable. EP-A-0 300 902 discloses another apparatus comprising a manually controlled pneumatic sprayer operated by a trigger. The compressed air flow rate is varied according to the position of the trigger. The flow rate of the two components is regulated by the signal given by the air flow information. Finally, EP-A-0 644 025 discloses an apparatus wherein the flow ratio of the components is regulated by the pressurized air flow which powers the motor.

One particular application for the above-mentioned apparatus is in the refinish industry. Conventional refinish methods for applying a coating composition to a substrate have been limited in several significant aspects. Typically, the components of the coating composition are mixed manually. Once mixed, the composition must be used within a certain time span, i.e. during its pot life, which is defined as the time when the mixture is suitable for spraying. More specifically, the pot life is the point at which the operator can perceive a discernible difference in ease of handling due to an increase in the viscosity of the mixed components. In general, the pot life is defined as a doubling of the viscosity as measured in a DIN flow cup number 4 according to DIN 53211-1987.

Manual mixing of the components often results in a large amount of waste. More particularly, it is impossible to prepare exactly the same coating composition twice. Accordingly, a large amount of coating composition is prepared before spraying to ascertain that there will be enough coating composition to spray the substrate. Thus, a certain amount of coating composition will always be left over after spraying which cannot be used anymore because of its pot life running out. Hence, the remaining coating composition will be thrown away as chemical waste.

In view of the above, there is need for an improved apparatus for applying a multi-component coating composition.

SUMMARY OF THE INVENTION

The present invention is directed to an apparatus for applying multi-component coating compositions comprising at least two dosing devices, an air-assisted spray gun (19), and a controlling device, each dosing device comprising a supply container (3,14) comprising one component of the multi-component coating composition (A,B), a motoring device (11A,11B), and a metering device (9,13), said supply container being connected to said metering device (9,13), said metering device (9,13) being connected to said motoring device (11A,11B) and to said air-assisted spray gun (19), the connecting line (41) between at least one metering device (9) and said air-assisted spray gun (19) being fitted with a pressure transducer (5A) having means for measuring a decrease in pressure in said connecting line (41), said pressure transducer (5A) being connected to said controlling device, and said controlling device being connected to said motoring devices (11 A,11B), said controlling device having means for comparing the decrease in pressure in said connecting line (41) with a set value, means for starting up said motoring devices (11A,11B), and means to control the power of said motoring devices (11A,11B) to keep the pressure in said connecting line (41) to the set value.

BRIEF DESCRIPTION OF THE DRAWINGS

The invention is further illustrated by the following drawings.

DETAILED DESCRIPTION OF THE INVENTION

Figure 1:
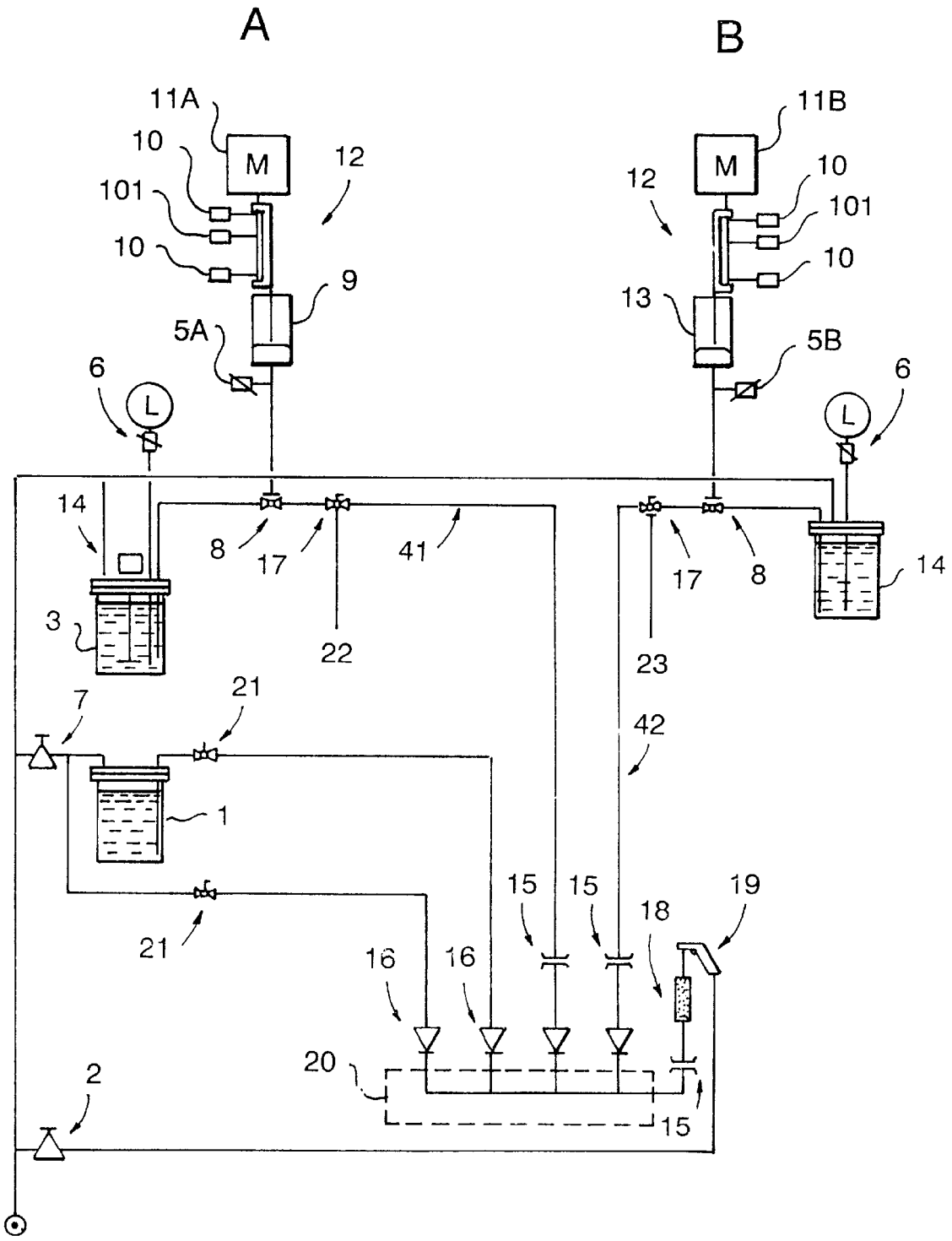
FIG. 1 is a schematic drawing of one embodiment of an apparatus according to the present invention for applying a multi-component coating composition.

The numbers mentioned above and in the following description are for explanatory reasons only and cannot be construed to limit the invention in any way.

Said motoring device may be any motor, with the proviso that the operation of the metering device can be controlled by the number of rotations, steps, or pulses, made by the motor. For example, a motor may be fitted with an encoder to count the number of pulses made. It is preferred that said motoring device is a stepper motor. All possible stepper motors may be employed, with the proviso that they provide sufficient torque.

The mixing ratio of the components is translated to a ratio of steps to be taken by the stepper motors. One stepper motor taking a particular number of steps, the other stepper motor (s) is(are) operated at a number of steps in direct ratio thereto. In the case of an apparatus for a two-component coating composition, mixing ratios of 1:100 to 100:1 which are continuously variably adjustable can be obtained. If necessary, a gear box can be fitted between at least one stepper motor and a metering device to increase the number of steps to be made, thus providing more variation and accuracy in the mixing ratio.

For homogeneous mixing of the components of the coating composition prior to spraying a mixing device may be present between the metering devices and the air-assisted spray gun. Such a mixing device may comprise a mixing block in which a dynamic mixer is integrated or a mixing block (20) and a static mixer (18). Such a static mixer may be integral with the air-assisted spray gun.

The coating composition volume can be minimized by close coupling of the mixing device to the air-assisted spray gun.

Alternatively, the components of a coating composition can be separately sprayed in such proximity that homogeneous mixing of the droplets occurs in the air and/or on the substrate. Such an embodiment may involve a dual nozzled spray gun.

The connecting line (41) between at least one metering device (9) and the air-assisted spray gun (19) is fitted with a pressure transducer (5A). The metering device (9) contains only one component (A). Consequently, only one component (A) flows through said connecting line (41). Accordingly, when a mixing device (20,18) is present in the apparatus of the present invention, the pressure transducer (5A) is fitted between the metering device (9) and the mixing device (20,18).

In a preferred embodiment the metering devices are positive displacement pumps, more preferably dosing cylinders. These dosing cylinders need not be of the same volume. For example, in an apparatus for a two-component coating composition comprising a binder A and a hardener B, more binder A is needed than hardener B. Accordingly, the dosing cylinder for hardener B may be smaller than the dosing cylinder for binder A. If the dosing cylinders have different volumes, this difference has to be taken into account when the set mixing ratio is translated to the drive of the motoring devices.

When a mixing device is present in the apparatus, another supply container (1) containing solvent may be present, in addition to the supply containers (3,14) for the different components of the multi-component coating composition, said solvent supply container being connected to said mixing device. The solvent is used to clean the connecting lines containing the mixed coating composition. More particularly, when the substrate has been sprayed with the necessary amount of coating composition, some residual coating composition will remain in the mixing device and in the connecting line between the mixing device and the air-assisted spray gun. When the pot life of the coating composition runs out, the mixing device and the connecting line between the mixing device and the air-assisted spray gun will become clogged due to the coating composition hardening. To prevent clogging, the connecting lines have to be cleaned by running a solvent through them. Also connected to the mixing device may be a connecting line providing pressurized air. It has been found that a solvent-air mixture cleans the connecting lines more thoroughly than solvent alone does. In addition to that, less solvent is needed to obtain the same level of cleanness.

The supply containers may be mounted above the dosing cylinders to enable them to be filled under the action of gravity. Alternatively, the supply containers may be pressurized containers, more preferably pressurized storage drums.

The controlling device has to be capable of storing data and of actuating and monitoring the parameters during the spraying process. Such a controlling device may be a dedicated controller, such as a programmable logic controller (PLC) or a central processing unit (CPU). Data and procedures may be stored in it from a computer via an interface, such as an RS 232 interface.

With reference to the drawings, FIG. 1 shows one embodiment of the apparatus of the present invention. A component A in a Falcon pressurized storage drum 3, ex Technospray, fitted with a pneumatical stirrer 4, and a component B in a Falcon pressurized storage drum 14, ex Technospray, are connected to a 500 cc dosing cylinder 9, EDV 6110105 s, ex MGV Moest, and a 250 cc dosing cylinder 13, EDV 6110106 s, ex MGV Moest, respectively, via a pneumatically controlled 3-way ball valve 8. The pressurized storage drums 3 and 14 are fitted with a level detector 6, FTL 365-IGR2AA2E, ex Endress+Hauser. Each dosing cylinder (9,13) is powered by a stepper motor (11A, 11B), Berger, RDM 599/50 Ex, ex Electro Abi, via a ball circulating spindle 12, having a pitch of 5 mm, ex SKF, fitted with two limit switches 10 and a home sensor 101. The connecting lines 41 and 42 between the dosing cylinders (9,13) and the pneumatically controlled 3-way ball valve 8 are fitted with pressure transducers 5A and 5B, 891.23.500 V-G½", ex Econosto Negret. Each dosing cylinder (9,13) is connected to a mixing block 20 via the pneumatically controlled 3-way ball valve 8. The connecting lines 41 and 42 between the pneumatically controlled 3-way ball valve 8 and the mixing block 20 are fitted with a 3-way ball valve 17 controlled by hand and connected to draining apertures 22 and 23, a quick release 15, and a non-return valve 16. The mixing block 20 is connected to a static mixer 18, also via a quick release 15. The static mixer 18 is connected to a manually controlled air-assisted spray gun 19. Also connected to the mixing block 20 are a Falcon pressurized storage drum 1, ex Technospray, containing solvent and a connecting line to provide pressurized air. Both connecting lines are fitted with a pneumatically controlled 2-way ball valve 21 and a non-return valve 16. The lines used to provide pressurized air connected to the pressurized storage drum 1 and to the air-assisted spray gun 19 are fitted with air pressure reducing valves 2 and 7.

Figure 2:
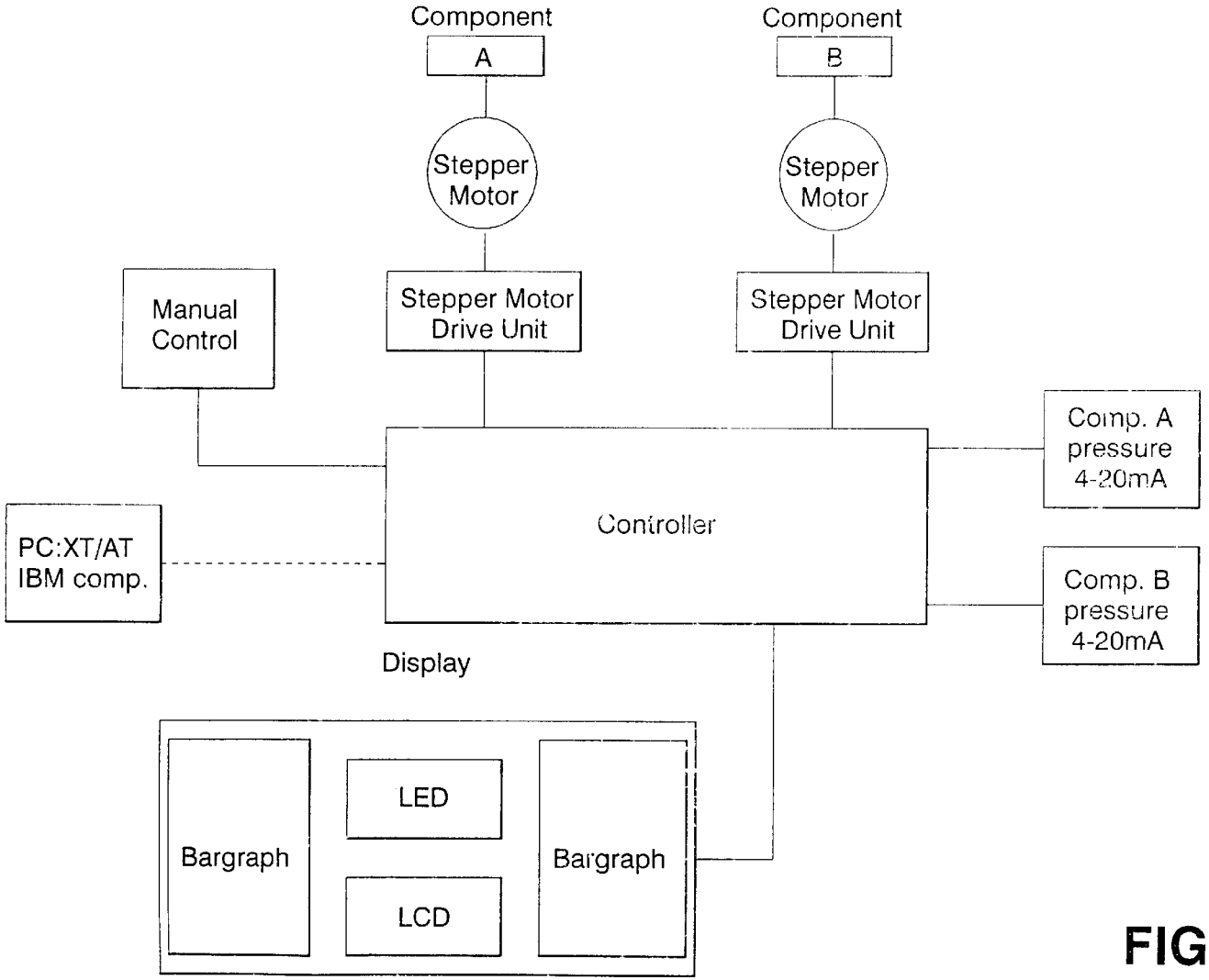
FIG. 2 is a block diagram of a controlling device used for the apparatus described in FIG. 1.

FIG. 2 provides a very schematic block diagram of an embodiment of a controlling device used in the apparatus described in FIG. 1. It shows a dedicated controller linked to an IBM personal computer XT/AT via a disconnectable line. Via the manual control set values, such as the pressure in the connecting lines 41 and 42 between the metering devices (9,13) and the mixing block (20), a mixing ratio of the components (A,B), and a pot life, can be introduced in the controller. Two pressure transducers (5A,5B) are connected to the controller to signal a decrease or increase of pressure in the connecting lines (41,42) between the metering devices (9,13) and the manually controlled air-assisted spray gun (19). The controller powers two stepper motors (11A,11B) for dosing cylinders (9,13) comprising component A and component B. The display provides an LCD display, a seven segment LED display, two Bargraph displays, and two warning lights. The LCD display may show the set values and optionally the flow rate calculated from the number of steps taken by the stepper motors (11A,11B). It is also possible to provide a problem analysis on the LCD display. The Bargraph display may show the level of components present in the dosing cylinders (9,13) and the refill action. One of the warning lights may be used to provide a low level warning for the level in the supply containers (3,14). The LED display is used to show the remaining pot life.

Figure 3:
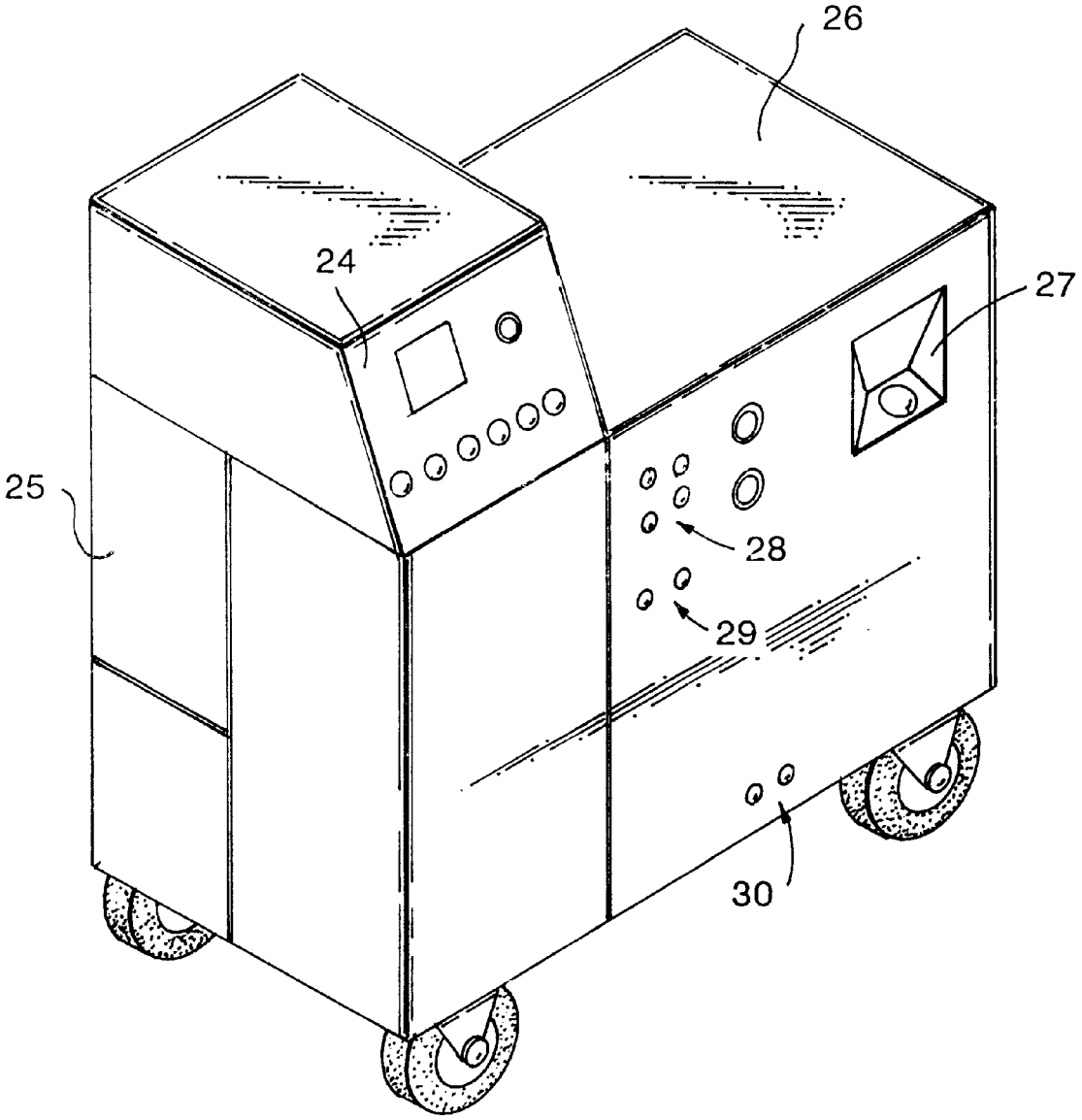
FIG. 3 is a perspectival front view of a housing comprising the apparatus described in FIG. 1.

FIG. 3 is a perspectival front view of a housing comprising the apparatus of described in FIG. 1. 24 is a pressurized cabinet comprising a control panel and the stepper motors. On the control panel the display of the controlling device is mounted, as well as the manual control of the controlling device mentioned in FIG. 2 comprising buttons to introduce the set values for the pot life, the pressure in the connecting lines between the metering devices and the mixing device, and the mixing ratio, and buttons for the forced refill of the dosing cylinders and the forced cleaning of the air-assisted spray gun. 25 is a pressurized cabinet for electrical components such as the 2K controller. 26 is a workbench. 27 is a waste outlet into which remaining mixed coating composition and solvent is sprayed. An air-assisted spray gun cleaning unit may be mounted on the housing. This is further explained in FIG. 5. 28 stands for the outlets for air, solvent, component A, and component B. 29 stands for the outlets for the apertures 22 and 23. 30 stands for inlets for the air and the power supply.

Figure 4A:
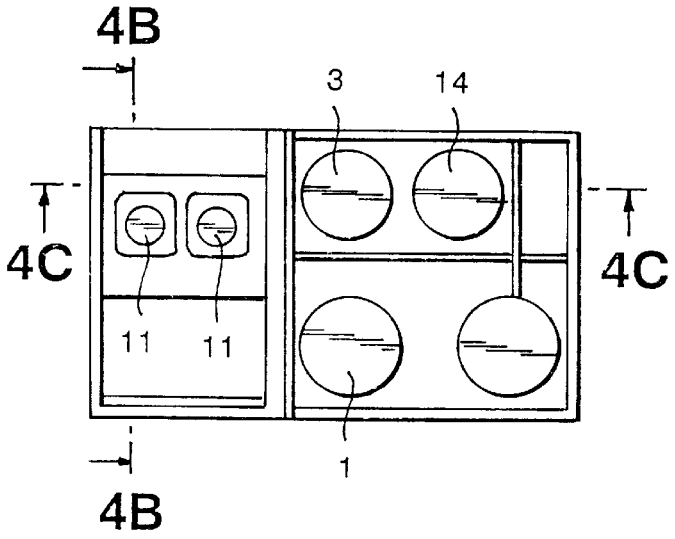
FIGS. 4A, 4B, 4C, and 4D are cross-sectional views of the housing of FIG. 3.
Figure 4B:
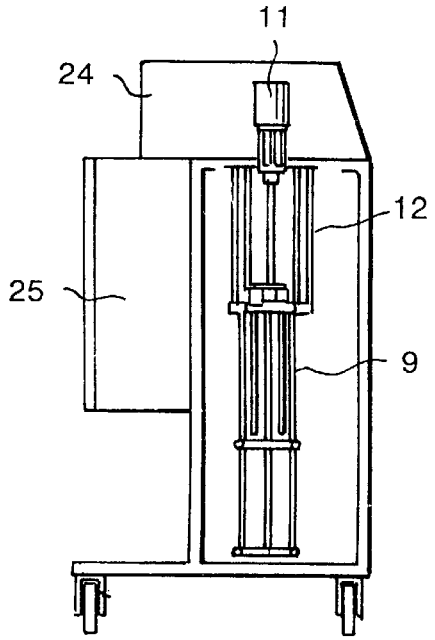
Figure 4C:
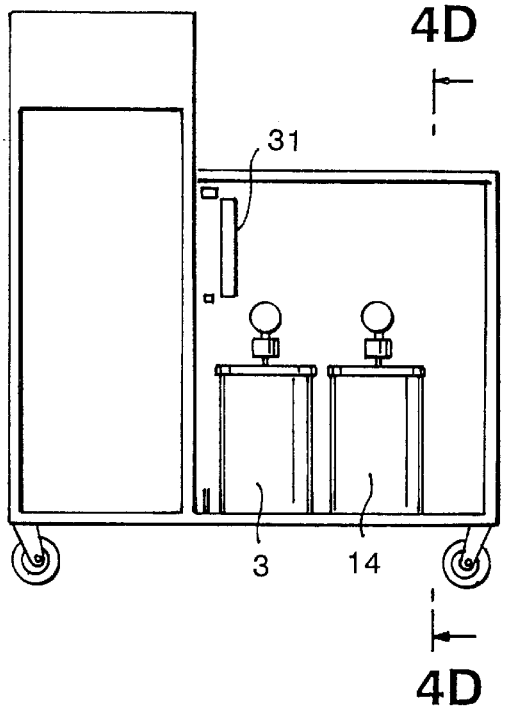
Figure 4D:
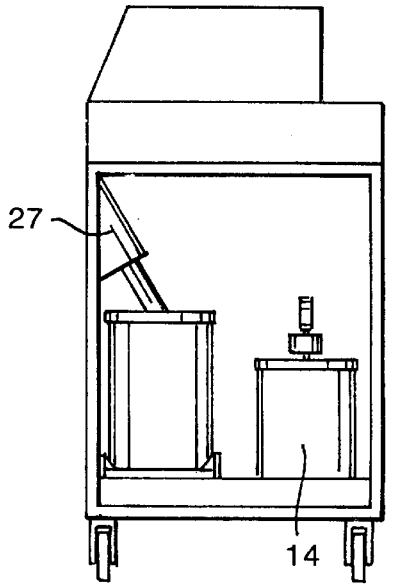

FIG. 4A is a top view of the housing of FIG. 3. FIG. 4B is a cross-section along line I—I of FIG. 4A. FIG. 4C is a cross-section along line II—Il of FIG. 4A. FIG. 4D is a cross-section along line III—III of FIG. 4C. The numbers refer to the numbers used in FIG. I and FIG. 3. In FIG. 4C an Orga pressurizing control unit F201 31 is mounted. The cabinets 24 and 25 comprising electrical components are pressurized to prevent explosion. To be sure that at the startup of the apparatus the two cabinets are filled with clean air and are explosion safe the connecting lines for air and power supply are interrupted by this Orga unit. When the power supply is activated, the Orga unit starts to purge the two cabinets with clean air, which it does a couple of times. When the two cabinets are pressurized, preferably about 0.9 mbar above ambient pressure, the power supply is connected to the controller and the apparatus can be started.

Figure 5:
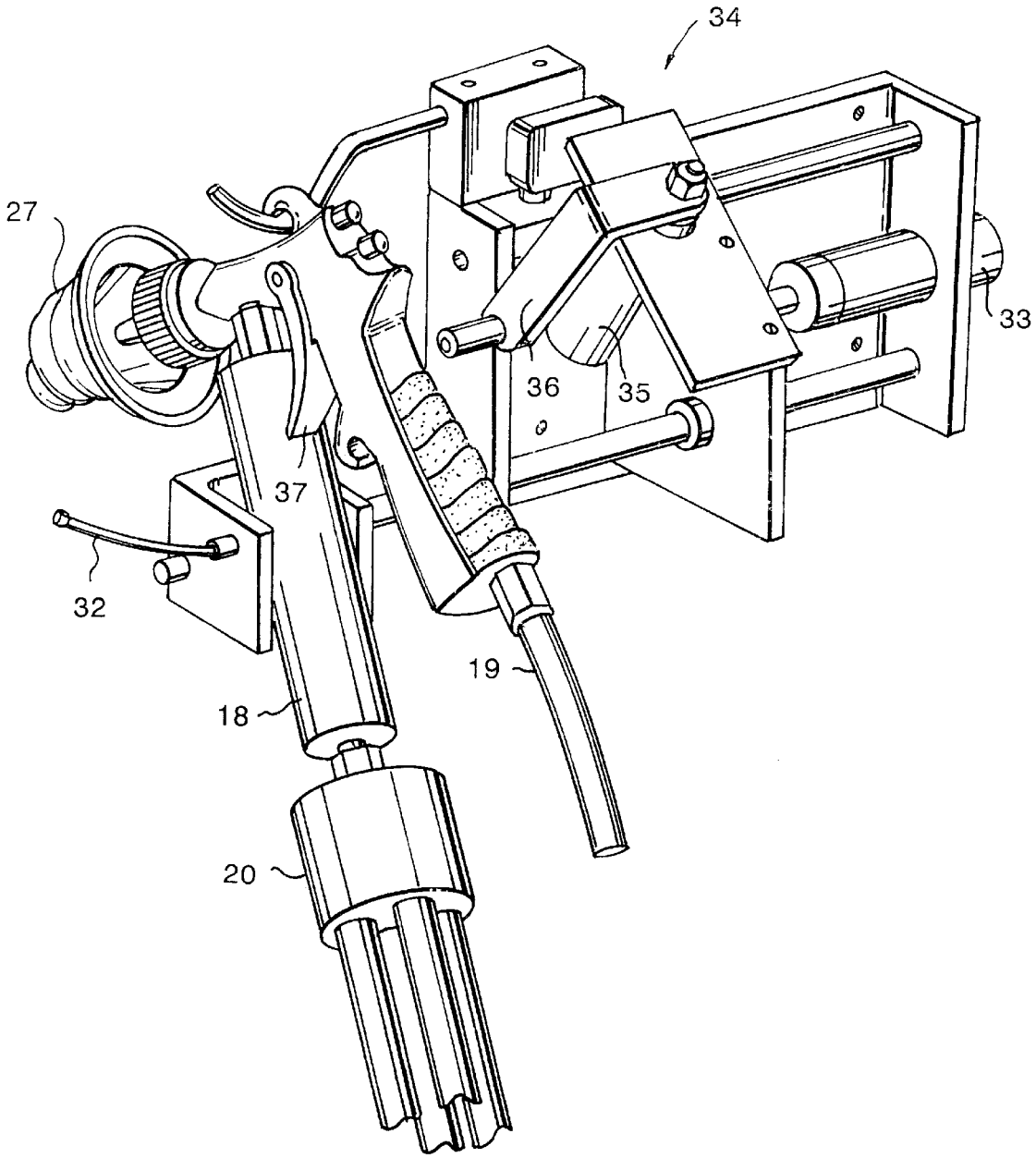
FIG. 5 is a drawing of an air-assisted spray gun cleaning unit mounted on the housing shown in FIG. 3.

FIG. 5 shows a drawing of the manually controlled air-assisted spray gun cleaning unit fitted on the housing at waste outlet 27. The manually controlled air-assisted spray gun 19 is shown with the mixing block 20 and the static mixer 18 attached to it. The manually controlled air-assisted spray gun is fitted with a trigger 37. The moment the manually controlled air-assisted spray gun is mounted in the cleaning unit, an inductive detector 32 signals its presence. The rod 33 having a pressurized air connecting line is pushed in the direction of the manually controlled air-assisted spray gun, moving the handle 36 to below the trigger 37. The detector 34 signals that the handle 36 is in place and rod 35 having a pressurized air connecting line is actuated. Its actuation pushes it upwards taking the handle 36 along. The handle 36 thus touches the trigger and opens the manually controlled air-assisted spray gun. The cleaning of the manually controlled air-assisted spray gun is started.

The operation of the apparatus according to the present invention is explained by referring to the above-mentioned figures. The dosing cylinders 9 and 13 are filled from the pressurized storage drums 3 and 14, respectively. Set on the controller by the manual control on the control panel are a pressure above ambient between 0.0001 and 5 bar, a mixing ratio, and a pot life. The moment the manually controlled air-assisted spray gun is opened, a pressure reduction in connecting line 41 is detected by pressure transducer 5A. The decrease in pressure is signaled to the controller, which starts up stepper motor 11A to return the pressure to and keep it on the set value. Stepper motor 11B is started up by the controller in direct ratio to the number of steps taken by stepper motor 11A translated from the set mixing ratio. The moment the manually controlled air-assisted spray gun is closed, an increase in pressure in connecting line 41 above the set value is detected by pressure transducer 5A having means for measuring an increase in pressure and signaled to the controller, which stops the stepper motors.

Pressure transducer 5B is a safety control. If the connecting line 42 between the dosing cylinder 13 and the mixing block 20 is blocked, the pressure increases in that line. If the pressure increases to above a certain level set for pressure transducer 5B, for example above 9 bar, the controller stops the stepper motors. The pneumatically controlled 3-way ball valve 8 is then turned by a signal of the controller (not shown in FIG. 2) to connect the dosing cylinder 13 to the supply container 14 to release the pressure from the system.

The stepper motors (11A,11B) start up nearly instantaneously when the air-assisted spray gun is opened. The pressure transducer 5A is able to signal differences in pressure of less than 0.1 mbar. Because of such small differences applied in the apparatus, the detection of the pressure decrease is nearly instantaneous, and the spraying of the substrate can be started immediately. The use of stepper motors also makes it possible to change the mixing ratio of the components with a nearly instantaneous changeover to the new mixing ratio.

When the substrate has been sprayed, the connecting line between the mixing block and the manually controlled air-assisted spray gun may be purged with a solvent-air mixture supplied via the pressurized storage drum 1 and an air pressure reducing valve 7. Also an alarm system may be present to monitor the pot life of the multi-component coating composition. The pot life is set on the controller. When the spraying process is stopped, the controller starts to count down to the pot life of the remaining coating composition. This is shown on the LED display on the control panel. Near the end of the pot life, the operator is made aware of the fact that the lines between the mixing block and the manually controlled air-assisted spray gun may become clogged in a matter of seconds. The manually controlled air-assisted spray gun should then be mounted in the manually controlled air-assisted spray gun cleaning unit shown in FIG. 5. At the end of the pot life, the unit starts cleaning the manually controlled air-assisted spray gun automatically.

The apparatus can also be totally cleaned for the next multi-component coating composition. The quick releases 15A and 15B fitted between the dosing cylinders (3,14) and the mixing block 20 are loosened and subsequently connected to connecting releases on the supply containers (not shown in FIG. 1).

The controller also provides the possibility of automatically refilling the dosing cylinders. More particularly, it is known how many steps the stepper motors have to take until the dosing cylinder are emptied. The controller counts the number of steps and when the maximum number of steps is reached, the apparatus is stopped automatically and the dosing cylinders are refilled. On the Bargraph display the refill action is shown.

The level detector 6 in the pressurized storage drum provides the possibility of automatically generating a low-level warning in the storage drums. More particularly, a vibrating fork is introduced into the supply containers. The change in resonance provides a measurement of the amount of component present in the container. With the decrease in resistance a low-level warning can be generated. At that moment the apparatus is stopped automatically. On the display a warning signal reflects the low-level warning. It is also possible to fit the supply containers with a weighing device. Knowing the weight of the supply container and the amount of component at the lowest possible level provides a value at which the automatic low-level warning can be set.

Forced refill and forced cleaning buttons are fitted on the control panel. Thus, the operator of the apparatus of the present invention is able at all times to refill the dosing cylinders even if they are not totally empty. The operator can also clean the manually controlled air-assisted spray gun by putting it in the cleaning unit and pushing the forced cleaning button without having to await the countdown of the pot life.

The draining apertures 22 and 23 are fitted in the apparatus to check the mixed coating composition. In principle this is not necessary, given the advantages of the apparatus of the present invention. However, some operators prefer such a manual check prior to spraying. The draining apertures can also be used to tap a small mixed quantity for other uses.

Because the pressure of the components in the connecting lines is the relevant property in the present invention, the apparatus has to be free from air which is compressible. Accordingly, it is preferred that the dosing cylinders are fitted in the apparatus upside-down. Thus, air from the supply container will accumulate at the top of the cylinder and will be forced out during filling. The connecting line to the mixing device will not contain any air.

Figure 6:
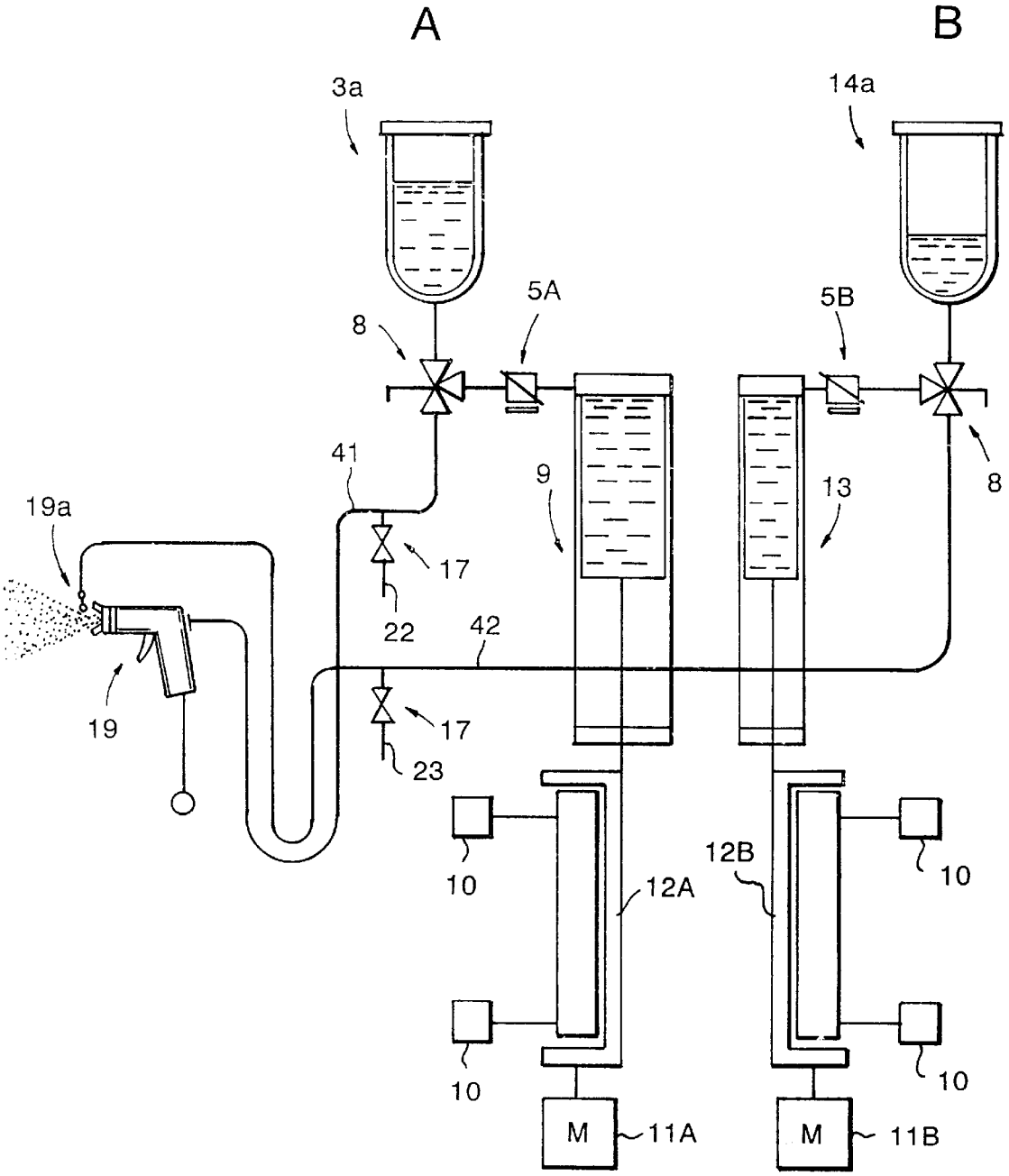
FIG. 6 is a schematic drawing of another embodiment of an apparatus according to the present invention.

FIG. 6 shows another embodiment of the apparatus of the present invention. Components A and B provided in supply containers 3*a* and 14*a* are connected to a 250 cc dosing cylinder 9, ex MGV Moest, and a 100 cc dosing cylinder 13, ex MGV Moest, respectively, via a pneumatically controlled 3-way ball valve 8. Each dosing cylinder (9,13) is powered by a stepper motor (11A,11B), RS 440–470, ex Mulder Hardenberg, via a ball circulating spindle 12A having a pitch of 5 mm, and 12B having a pitch of 2,5 mm, ex SKF, fitted with two limit switches 10. The connecting lines 41 and 42 between the dosing cylinders (9,13) and the pneumatically controlled 3-way ball valves 8 are fitted with pressure transducers 5A and 5B, 891.13.520, ex Econosto Negret. The dosing cylinders 9 and 13 are connected to a manually controlled air-assisted spray gun 19/19*a*, in both cases both via the pneumatically controlled 3-way ball valve 8. The connecting line between the pneumatically controlled 3-way ball valve 8 and the air-assisted spray gun 19/19*a* is fitted with a 3-way ball valve 17 controlled by hand and connected to draining apertures 22 and 23.

Figure 7:
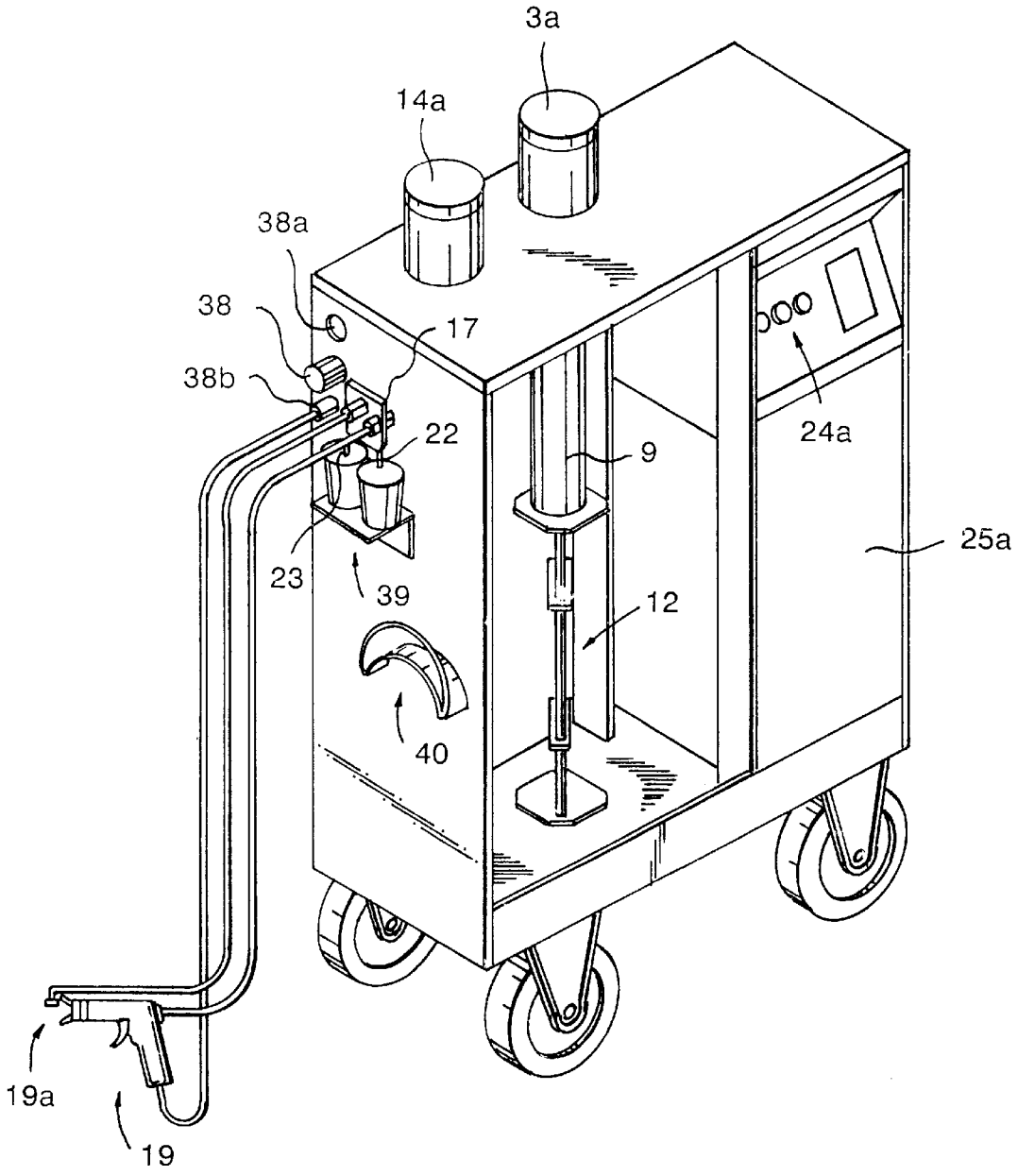
FIG. 7 is a perspectival front view of a housing comprising the apparatus described in FIG. 6.

FIG. 7 is a perspectival front view of a housing comprising the apparatus of FIG. 6. 24*a* is a cabinet comprising a control panel. On the control panel a display is mounted, as well as the manual control of the controlling device comprising buttons to introduce the set values for the pressure in the connecting lines between the metering devices and the air-assisted spray gun 19/19*a*, and the mixing ratio, and a button for the forced refill of the dosing cylinders. 25*a* is a cabinet for electrical components such as the dedicated controller. 38 is an adjustment button for the pressurized air, 38*a* is a pressure gauge for reading the pressure of the pressurized air, and 38*b* stands for the outlet for pressurized air. 39 stands for a shelf on which one or more cups may be placed for the outlets for the apertures 22 and 23. 40 stands for a hose bearer on which the connecting lines to the spray gun 19/19*a* may be hung. The stepper motors are mounted under the housing and, accordingly, are not shown.

Figure 8:
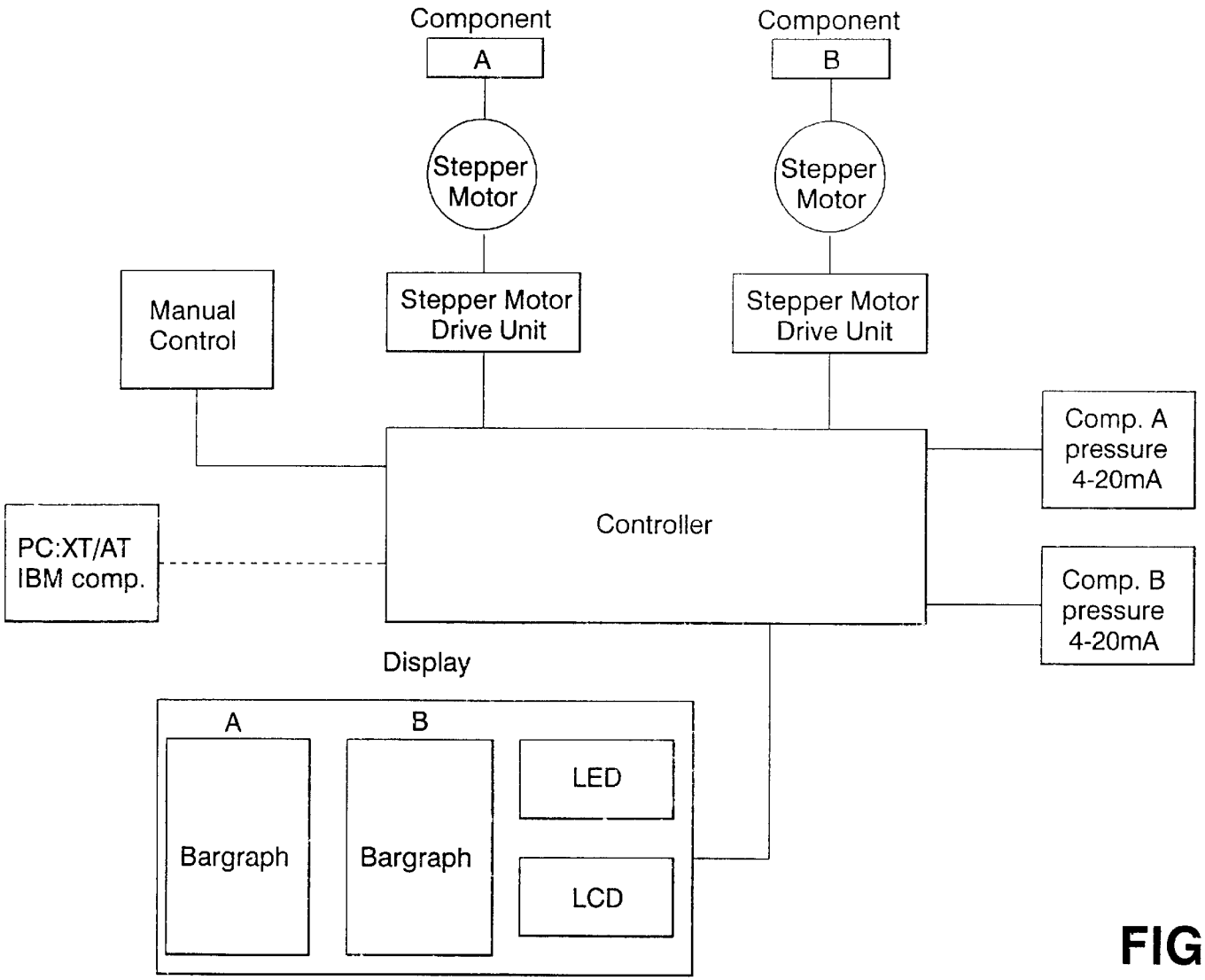
FIG. 8 is a block diagram of a controlling device used for the apparatus described in FIG. 6.

FIG. 8 provides a very schematic block diagram of an embodiment of a controlling device used in the apparatus described in FIG. 6. It is similar to the block diagram shown in FIG. 2. The only difference is the display providing two Bargraph displays put together and three warning lights.

The apparatus described in FIG. 6 works in a similar way as the apparatus described in FIG. 1. However, in the present apparatus the components A and B are separately sprayed in such proximity that homogeneous mixing of the droplets occurs in the air. For this embodiment a dual nozzled spray gun was simulated by coupling a spraying device 19*a* to an air-assisted spray gun 19. Furthermore, due to the fact that the components are mixed together outside the apparatus, it is no longer necessary to control the pot life of the coating composition and to provide a supply container with solvent.

It is clear from the above that the controlling device used in the apparatus of the present invention may comprise a large number of means to control the present apparatus. The controlling device has to have means for comparing the decrease in pressure in the connecting line between at least one metering device and the air-assisted spray gun with a set value, means for starting up the motoring devices, and means to control the power of the motoring devices to keep the pressure in the connecting line to the set value. Furthermore, the controlling device may have means for comparing the increase in pressure in the same connecting line with the set value, means for comparing the increase in pressure in another connecting line with a maximum value, and means for stopping the motoring devices when the pressure surpasses said values. In addition, the controlling device may have means to count a time period during which the spray gun is closed, comparing said time period with the set value of the pot life, means for setting off an alarm when the time period has reached said set value, and means to switch the 3-way ball valves. The controlling device may have means for taking into account the amount of components present in the respective metering devices, means to start up the refilling of said metering devices, and means for setting off an alarm when a low level is measured in the storage drums. Finally, when a cleaning unit is present, there may be means for receiving signals from detectors 32 and 34, means for moving rods 33 and 35, and means for starting the cleaning of the spray gun.

Advantages of the apparatus of the present invention include the continuously variable mixing ratios adjustable in a matter of seconds, flow rates adjustable by pressure signals, automatic pot life control, automatic cleaning cycle, automatic refill system, and low-level warning systems in the storage drums. Accordingly, the use of the apparatus and the process of the present invention make it possible to use multi-component coating compositions which have a very short pot life, for example as low as 1 minute or even less. It results also in an exactly reproducible coating composition, a quick change-over to other mixing ratios, lower use of material, less chemical waste, and higher productivity.

The apparatus of the present invention can be used for any coating composition which needs at least two separate components. These may be reactive components but also components of different colour which may be mixed in several ratios to provide colour variations.

When reactive components are used, all depends on the reactivity of the components. For example, the binder and the hardener may be present in one component and the catalyst in another, when said binder and hardener only interreact in the presence of that catalyst.

The coating composition for use in the present apparatus may include, but is not limited to, compositions comprising the following combination of functional groups: amine/isocyanate, amine/epoxy/isocyanate, hydroxy/isocyanate, amine/epoxy, epoxy/anhydride, hydroxy/isocyanate/amine, anhydride/hydroxy, amine/anhydride, unsaturated groups/aldimine, unsaturated groups/ketimine, acetoacetate/aldimine, and acetoacetate/ketimine. The catalyzed reaction of such a combination of functional groups can result in crosslinking polymerization reactions that cause curing of the coating composition. Such compositions range from commercially known systems to systems which have been hitherto been considered to act too fast for practical or commercial use.

The apparatus of the present invention is especially useful in the automotive industry for such coatings as clearcoats, basecoats, primers, and fillers. The apparatus is applicable for the finishing of large transport vehicles, such as trains, buses, and airplanes. The apparatus is also applicable in the refinish industry, in particular the body shop, to repair automobiles. Depending on the amount of coating composition necessary for the application, the apparatus of the present invention may be scaled up or down.

EXAMPLE

Figure 9:
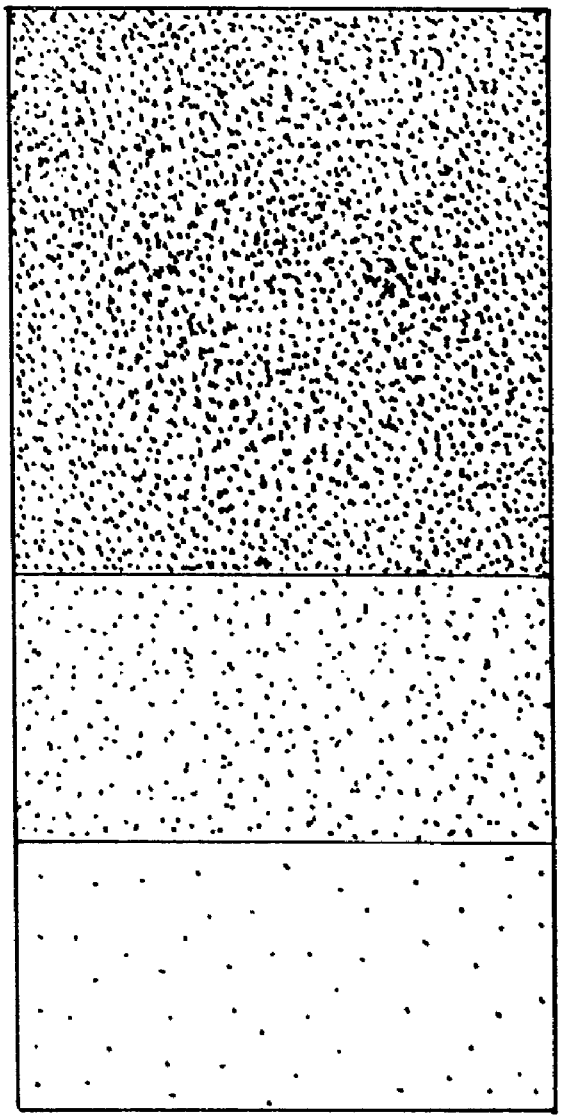
FIG. 9 is a representation of a test panel sprayed using an apparatus according to the invention.

The apparatus of the present invention was tested in a so-called black and white test. Autocryl® Plus binder, ex Sikkens, colour A110 (white), was introduced into the apparatus as component A. Autocryl® Plus binder, ex Sikkens, colour A160 (black), was diluted with 10% Thinner 1.2.3. fast, and introduced into the apparatus as component B. A panel was sprayed with the apparatus, with the mixing ratio of the two components changing frequently. The resulting panel is shown in FIG. 9.

Such a panel is prepared in a matter of minutes. Colour spatters or colour paths are not detected on this panel. Such results were not available up till now.

We claim:

1. An apparatus for applying multi-component coating compositions comprising at least two dosing devices, an air-assisted spray gun, and a controlling device, each dosing device comprising a supply container comprising one component of the multi-component coating composition, a motoring device, and a metering device, said supply container being connected to said metering device, said metering device being connected to said motoring device and to said air-assisted spray gun, the connecting line between at least one metering device and said air-assisted spray gun being fitted with a pressure transducer capable of measuring a decrease in pressure in said connecting line, said pressure transducer being connected to said controlling device, and said controlling device being connected to said motoring devices, said controlling device capable of:

comparing the decrease in pressure in said connecting line with a set value, starting up said motoring devices, and controlling the power of said motoring devices to keep the pressure in said connecting line to the set value.

2. An apparatus according to claim 1 wherein said metering device is connected to a mixing device and said mixing device is connected to said air-assisted spray gun.

3. An apparatus according to claim 2 wherein said mixing device comprises a mixing block connected to a static mixer.

4. An apparatus according to claim 1 wherein said motoring device is a stepper motor.

5. An apparatus according to claim 1, wherein said metering device is a dosing cylinder.

6. An apparatus according to claim 5 wherein the dosing cylinders are fitted upside-down in the apparatus.

7. An apparatus according to claim 1 wherein the connecting line between at least one other metering device and said air-assisted spray gun is fitted with a pressure transducer, said pressure transducer capable of measuring the increase in pressure in said connecting line.

8. An apparatus according to claim 7 wherein the controlling device is capable of comparing the increase in pressure in said connecting line with a maximum value and stopping the motoring devices once said maximum value has been reached.

9. An apparatus according to claim 2 wherein a supply container containing solvent is present, said solvent supply container being connected to said mixing device.

10. An apparatus according to claim 9 wherein there is a connecting line to said mixing device providing pressurized air.

11. An apparatus according to claim 1 wherein said supply container is a pressurized storage drum.

12. A process for applying a multi-component coating composition using an apparatus according to claim 1, said process comprising a) filling the metering devices from the supply containers, b) setting a pressure above ambient and a mixing ratio on the controlling device, c) signaling to the controlling device the decrease in pressure from the pressure transducer fitted in the connecting line between one metering device and the air-assisted spray gun the moment the air-assisted spray gun is opened, d) starting up one motoring device to increase the pressure to the set level, e) starting up the other motoring device(s) to follow the first motoring device in the set mixing ratio, and f) spraying a substrate.

13. A process according to claim 12, comprising the additional steps of bb) setting a maximum pressure on the controlling device, ee) signaling the increase in pressure from a second pressure transducer fitted in the connecting line of another metering device and said air-assisted spray gun, and ff) stopping the apparatus the moment the pressure reaches the maximum pressure value.

14. A process for applying a multi-component coating composition using an apparatus according to claim 9, said process comprising a) filling the metering devices from the supply containers, b) setting a pressure above ambient and a mixing ratio on the controlling device, c) signalling to the controlling device the decrease in pressure from the pressure transducer fitted in the connecting line between one metering device and the air-assisted spray gun the moment the air-assisted spray gun is opened, d) starting up one motoring device to increase the pressure to the set level, e) starting up the other motoring device(s) to follow the first motoring device in the set mixing ratio, f) spraying a substrate, and g) when the substrate has been sprayed, running a solvent through said connecting line.

15. A process for applying a multi-component coating composition using an apparatus according to claim 10, said process comprising a) filling the metering devices from the supply containers, b) setting a pressure above ambient and a mixing ratio on the controlling device, c) signalling to the controlling device the decrease in pressure from the pressure transducer fitted in the connecting line between one metering device and the air-assisted spray gun the moment the air-assisted spray gun is opened, d) starting up one motoring device to increase the pressure to the set level, e) starting up the other motoring device(s) to follow the first motoring device in the set mixing ratio, f) spraying a substrate, and g) when the substrate has been sprayed, purging said connecting line between said air-assisted spray gun with a solvent-air mixture.

* * * * *